US008918043B2

(12) United States Patent
Yoshida

(10) Patent No.: US 8,918,043 B2
(45) Date of Patent: Dec. 23, 2014

(54) IMAGE HEATING APPARATUS

(71) Applicant: Canon Kabushiki Kaisha, Tokyo (JP)

(72) Inventor: Keisuke Yoshida, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 55 days.

(21) Appl. No.: 13/689,005

(22) Filed: Nov. 29, 2012

(65) Prior Publication Data

US 2013/0142552 A1 Jun. 6, 2013

(30) Foreign Application Priority Data

Dec. 1, 2011 (JP) ..... 2011-264056

(51) Int. Cl.
*G03G 15/20* (2006.01)

(52) U.S. Cl.
CPC ..... *G03G 15/2085* (2013.01); *G03G 15/2053* (2013.01); *G03G 2215/2035* (2013.01)
USPC ..... 399/329; 399/122; 399/333; 219/216

(58) Field of Classification Search
USPC ..... 399/122, 329, 333; 219/216
See application file for complete search history.

(56) References Cited

U.S. PATENT DOCUMENTS

| | | | | |
|---|---|---|---|---|
| 5,196,895 | A * | 3/1993 | Setoriyama et al. | 399/328 |
| 7,764,895 | B2 * | 7/2010 | Tomine et al. | 399/69 |
| 2003/0228171 | A1 * | 12/2003 | Miyabe et al. | 399/111 |
| 2011/0026990 | A1 * | 2/2011 | Arimoto | 399/333 |
| 2011/0081174 | A1 * | 4/2011 | Baba | 399/329 |

FOREIGN PATENT DOCUMENTS

JP 10-171276 A 6/1998

* cited by examiner

*Primary Examiner* — Francis Gray
(74) *Attorney, Agent, or Firm* — Fitzpatrick, Cella, Harper & Scinto

(57) ABSTRACT

An image heating apparatus includes; an endless belt; a plate-like heater slidable on an inner surface of the belt; a driving roller, opposed to the heater through the belt, for rotating the belt and for forming a nip for heating an image on a sheet; an energy supply member including an electrical contact for supplying electrical energy to the heater; a flange provided with a guide for guiding rotation of the belt and a stopper for limiting movement of the belt in an axial direction; and a pressure applying member for applying pressure between the flange and the driving roller. The flange includes a fixing portion for fixing the energy supply member with a predetermined play in a pressing direction of the pressure applying member so that the flange is disengageable in the axial direction relative to the belt integrally with the energy supply member.

5 Claims, 8 Drawing Sheets

(a)

(b)

IMAGE HEATING APPARATUS

FIELD OF THE INVENTION AND RELATED ART

The present invention relates to an image heating apparatus for heating an image on a recording material. The image heating apparatus can be used with an image forming apparatus such as a copying machine, a printer, a facsimile machine or a complex machine having a plurality of such functions.

In a known electrophotographic type image forming apparatus, a toner image formed by an electrophotographic process is transferred onto the recording material, then, the recording material having the transferred toner image is subjected to a fixing operation by which the toner image is fixed on the recording material by heating and pressing by a fixing device (image heating apparatus).

Japanese Laid-open Patent Application Hei 10-171276 proposes a fixing device which uses a thin low thermal capacity type endless belt from the standpoint of quick start property and/or energy saving.

More specifically, the endless belt is heated by a ceramic heater, and the endless belt is rotated by a pressing roller.

In such a conventional fixing device, when the endless belt reaches the durable lifetime thereof, the entirety unit is exchanged with the endless belt.

However, from the standpoint of environmental protection, it is desirable that the endless belt alone is exchangeable. In this case, simplification of the operation of exchanging the endless belt is desired.

SUMMARY OF THE INVENTION

Accordingly, it is a principal object of the present invention to provide an image heating apparatus in which an endless belt can be easily exchangeable.

According to an aspect of the present invention, there is provided an image heating apparatus comprising an endless belt; a plate-like member having a heat generating element which is slidable on an inner surface of said endless belt; a driving rotatable member, opposed to said plate-like member through said endless belt, for rotating said endless belt and for forming a nip for heating an image on a recording material; an electric energy supply member including an electrical contact for supplying electric energy to said heat generating element; a flange member provided with a guide portion for guiding rotation of the endless belt and a stopper portion for limiting movement of said endless belt in an axial direction; and a pressure applying member for applying a pressure between said flange member and said driving rotatable member, wherein said flange member includes a fixing portion for fixing said electric energy supply member with a predetermined play in a pressing direction of said pressure applying member so that said flange member is disengageable in the axial direction relative to said endless belt integrally with said electric energy supply member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
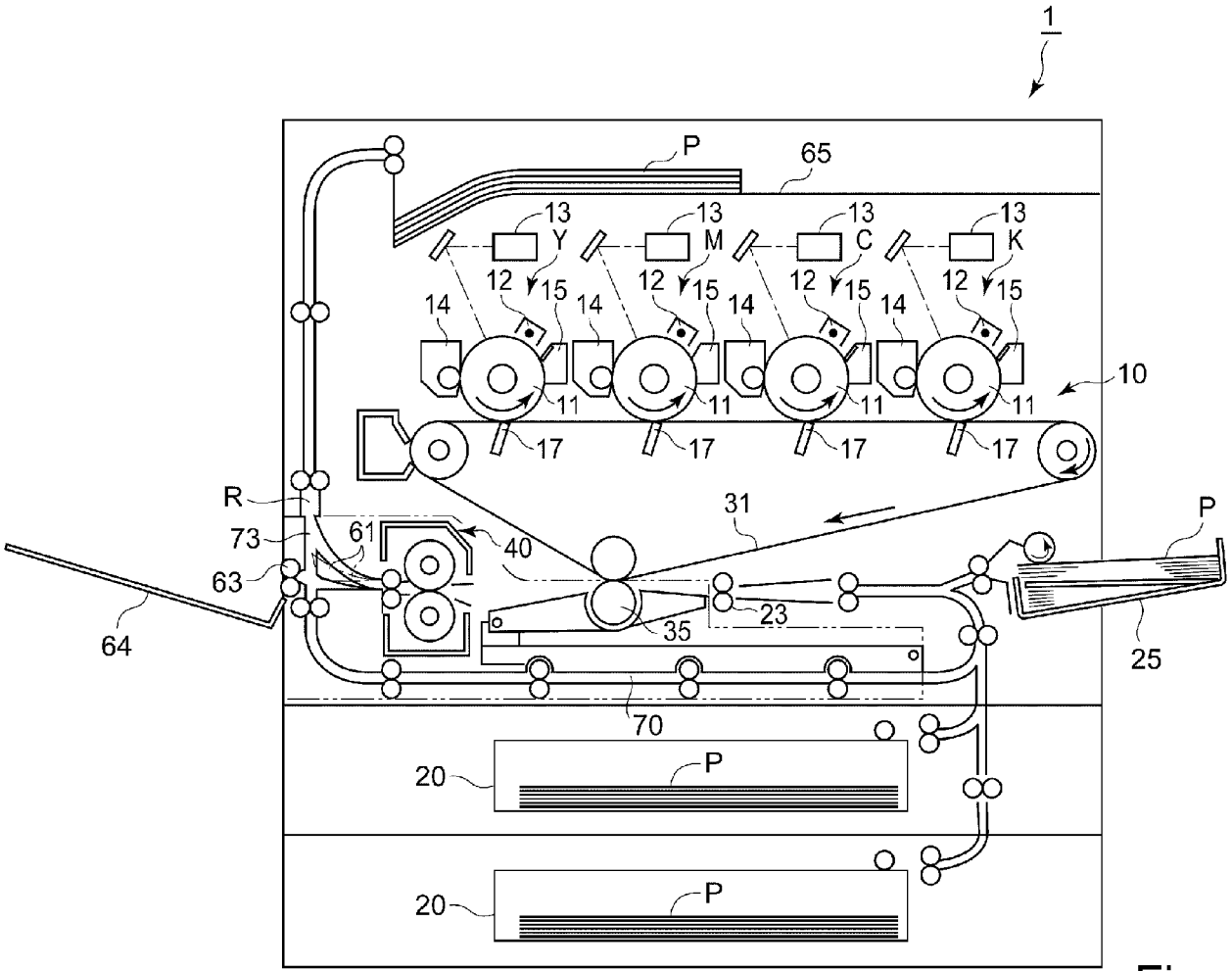
FIG. 1 is a schematic illustration of an image forming apparatus according to an embodiment of the present invention.

Referring to FIG. 1 to FIG. 10, an embodiment of the present invention will be described. Referring first to FIG. 1, a schematic structure of the image forming apparatus of this embodiment will be described.

Image Forming Apparatus

FIG. 1 is a sectional view of a color electrophotographic printer as an example of the image forming apparatus of this embodiment, taken along a feeding direction of a recording material. The color electrophotographic printer (image forming apparatus) will be called simply "printer", hereinafter. A toner image is formed on the recording material. As for specific examples of the recording material, there are plain paper, resin material sheet as a substitute of the plain paper, thickness paper, overhead projector sheet.

An image forming station 10 of a printer 1 includes image forming stations Y, M, C, K for forming toner images of the Y (yellow), M (magenta), C (cyan), Bk (black), respectively. The image forming stations are provided with image bearing members (photosensitive member, that is, photosensitive drum 11, respectively. The photosensitive drum 11 is charged by a charger 12. Thereafter, a latent image is formed on the photosensitive drum 11 by a laser scanner 13. The latent image is developed into a toner image by a developing device 14. The toner image on the photosensitive drum 11 is transferred sequentially by a primary transfer blade 17 onto an image bearing member which is an intermediary transfer belt 31, for example. After the image transfer, the toner remaining on the photosensitive drum 11 is removed by a cleaner 15. As a result, the surface of the photosensitive drum 11 is cleaned to prepare for the next image formation.

On the other hand, the recording material P is delivered one by one from a sheet feeding cassette 20 or a multi-sheet feeding tray 25 and is fed to a registration roller pair 23. The registration roller pair 23 functions to correct oblique feeding of the recording material by stopping the recording material P temporarily. The registration roller pair 23 feeds the recording material into between the intermediary transfer belt 31 and a secondary transfer roller 35 in synchronism with the toner image on the intermediary transfer belt 31. The color toner image on the intermediary transfer belt is transferred onto the recording material P by a transfer member which is the secondary transfer roller 35, for example. Thereafter, the toner image on the recording material is heated and pressed by a fixing device 40 which is a heating apparatus, so that the toner image is fixed on the recording material.

In the case that the toner image is formed only on one side of the recording material, a switching flapper 61 is switched such that the recording material is discharged to a sheet discharge tray 64 provided at a side surface of the printer 1 by sheet discharging rollers 63. Or, it is discharged to a sheet discharge tray 65 provided at the top side of the printer 1. When the switching flapper 61 takes the position indicated by broken lines, the recording material is discharged on the sheet discharge tray 64 in the face up state, and when the switching flapper 61 takes the solid line position, the recording material is discharged to the sheet discharge tray 65 in the face down state.

When the toner images are formed on the respective sides of the recording material, the recording material on the first side of which the toner image is fixed by the fixing device 40 is guided upward by the switching flapper 61 taking the solid line position. When the trailing edge of the recording material reaches a reversion point R, the recording material is switched back by the feeding path 73 and is reversed in its orientation. Thereafter, the recording material is fed in the duplex print feeding path 70 and is subjected to the image forming operation similar to the case of the first side image forming operation so that a toner image is formed on the second side of the recording material and then is discharged on the sheet discharge tray 64 or the sheet discharge tray 65. The portion comprising the switching flapper 61, the feeding path 73 and so on is an example of the reversing means.

Fixing Device

Figure 2:
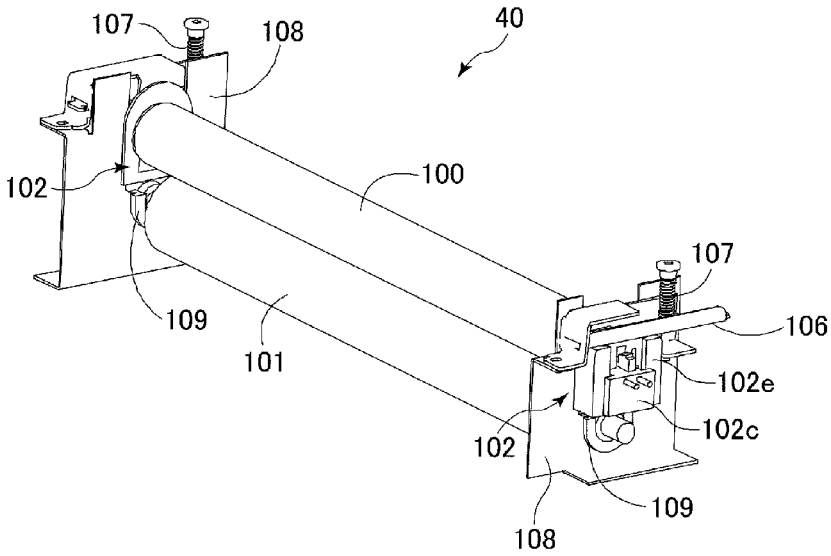
FIG. 2 is a perspective view of a fixing device of this embodiment.
Figure 3:
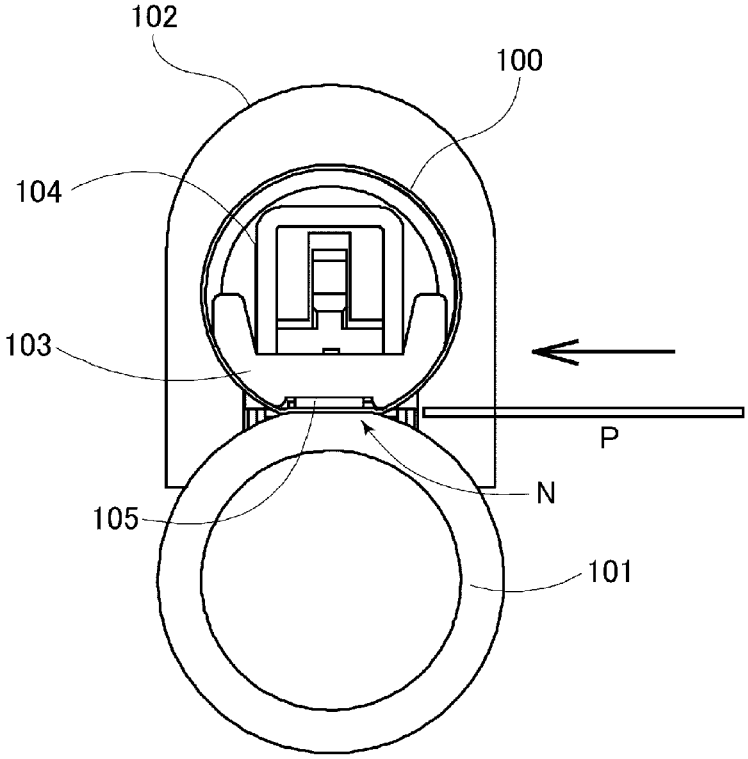
FIG. 3 is a sectional view of the fixing device of this embodiment.
Figure 4:
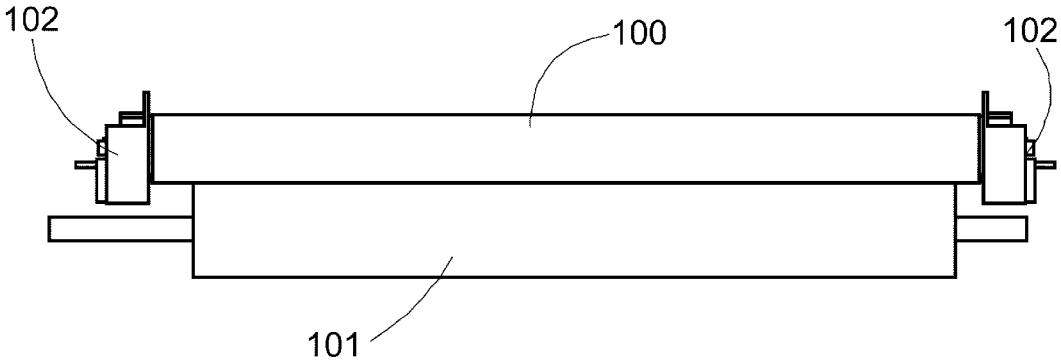
FIG. 4 is a side view of the fixing device of this embodiment.

Referring to FIG. 2 through FIG. 4, the fixing device 40 functioning as the image heating apparatus will be described.

The fixing device 40 of this embodiment comprises a rotatably supported endless belt member 100 and a pressing roller 101 as a driving rotatable member for forming a nip N (FIG. 3) by contacting to the outer surface of the belt member 100 and for rotating the belt member 100.

The fixing device 40 is a belt member heating type device using a belt member 100 comprising a cylindrical base layer of thin metal and an elastic layer thereon. By nipping and feeding the belt member 100 between the pressing roller 101 and a heater which will be described hereinafter, the toner image on the recording material P is fixed in the nip N formed between the belt member 100 and the pressing roller 101.

The fixing device 40 further comprises a heater 105 having a thickness of approx. 0.8 mm and made of thin-plate-like ceramic, a back-up member 103 forming a nip N by pressed to the pressing roller 101 through the belt member 100, and a stay 104 provided in a belt member. Furthermore, it comprises temperature detecting means for detecting an inner surface temperature of the belt member 100 and for feeding the detection result to a control circuit (unshown).

The belt member 100 is a cylindrical heat resistive member for transferring the heat from the heater 105 to the recording material P, and is fitted loosely around a cylindrical belt member supporting portion 102*a* as a belt member rotation regulating portion. The belt member supporting portion 102*a* will be described hereinafter. In order to reduce a thermal capacity and improve a quick start property, the belt member 100 has a film thickness of not more than 100 μm, preferably not more than 50 μm and not less than 20 μm. The base layer is a monolayer of heat resistive PTFE, PFA, FEP or the like. Or, belt member 100 may be of a composite layer structure including a base layer of polyimide, polyamide-imide, PEEK, PES, PPS or the like, and a coating of PTFE, PFA, FEP or the like on the outer surface thereof. Furthermore, the base layer may be made of metal such as SUS.

The pressing roller 101 comprises a core metal and a heat resistive elastic material layer such as silicone rubber, fluorine-containing rubber, fluorinated resin material, coaxially and integrally molded on the core metal, and a parting layer as a surface layer. The material of the parting layer may be selected from the high parting property and high heat resistive materials such as fluorinated resin material, silicone resin material, fluorosilicone rubber, fluorine-containing rubber, silicone rubber, PFA, PTFE, FEP. The opposite end portions of the core metal are rotatably supported by respective bearing members 109 of heat resistive resin material such as PEEK, PPS, liquid crystal polymer, and the bearing members 109 are supported fixing device side plates 108 provided at the respective end portions of the belt member 100 and the pressing roller 101.

The back-up member 103 is a heat resistive and heat insulative member having a substantially half-arc cross-section and extends in the direction crossing with the feeding direction (rotational axis direction of the belt member 100) of the recording material. The material of the back-up member 103 is made of high insulative property and high heat resistive property material such as phenolic resin, polyimide resin material, polyamide resin material, polyamide-imide resin material, PEEK resin material, PES resin material, PPS resin material, PFA resin material, PTFE resin material, LCP resin material or the like. The back-up member 103 functions to provide the nipping pressure of the nip N and to stabilize the feeding stability during rotation of the belt member 100.

The stay 104 is pressed against the back side of the relatively soft resin material back-up member 103 over the length to reinforce and correct the back-up member 103.

The heater 105 in the form of a plate-like member is a thin-plate-like heat generating element. In this embodiment, it is mainly constituted by an elongated thin-plate-like ceramic substrate, and an electric heat generating resistor layer on the substrate, and is a low thermal capacity heater such that by the electric power supply to the heat generating resistor layer, the temperature of the entirety thereof steeply rises. The heater 105 is engaged with a groove provided in the lower surface of the back-up member 103 along the longitudinal direction to be supported over the length. Thus, the heater 105 is disposed between the back-up member 103 and the pressing roller 101 in the endless traveling path of the belt member 100 and heats the nip N.

At the end portion (with respect to rotational axis direction of the belt member 100, the stay 104, the heater 105 and the supporting member 102 supporting the back-up member 103 are provided. The supporting member 102 is disposed at each of the opposite end portions of the belt member 100 to support the opposite end portions of these members. In this embodiment, the supporting member 102 functions as an electric energy supply member for electric power supplying to the heater 105. It is engaged with opposite end portions of an assembly comprising the back-up member 103 and the stay 104 and functions as a belt member holding portion for preventing disengagement of the belt member 100 while guiding the rotation of the belt member 100. In addition, it functions as a fixing device assembly holding portion slidably supported by the fixing device side plate 108.

In order to form the nip N between the belt member 100 and the pressing roller 101, the supporting member 102 is pressed by a pressing member 106 using a compression spring 107 as a pressure applying member. Since the supporting member 102 supports the stay 104 and the back-up member 103, the load to the supporting member 102 presses to the pressing roller 101 through the stay 104 and the back-up member 103. Thus, the compression spring 107 presses the stay 104 toward the pressing roller 101. By this, the back-up member 103 is pressed to the pressing roller 101 through the belt member 100 to form the nip N.

Figure 5:
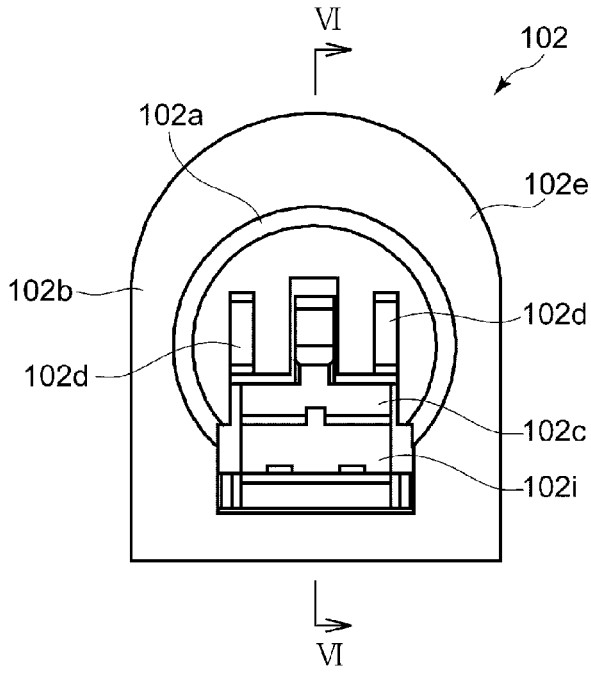
FIG. 5 is a front view (a) and a right-hand side view (b) illustrating a schematic structure of a supporting member in this embodiment.
Figure 5:
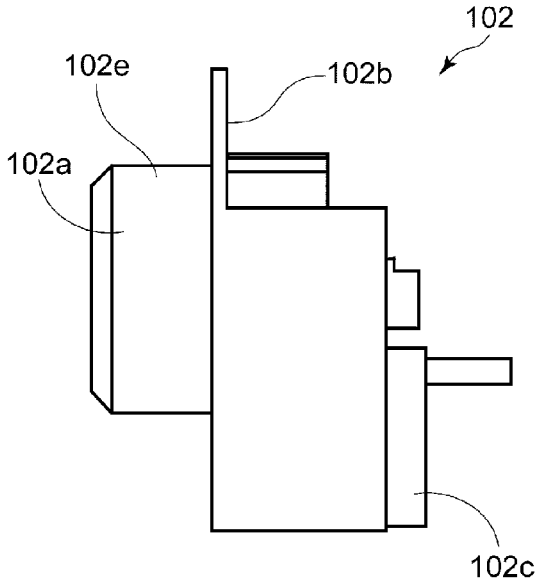
Figure 6:
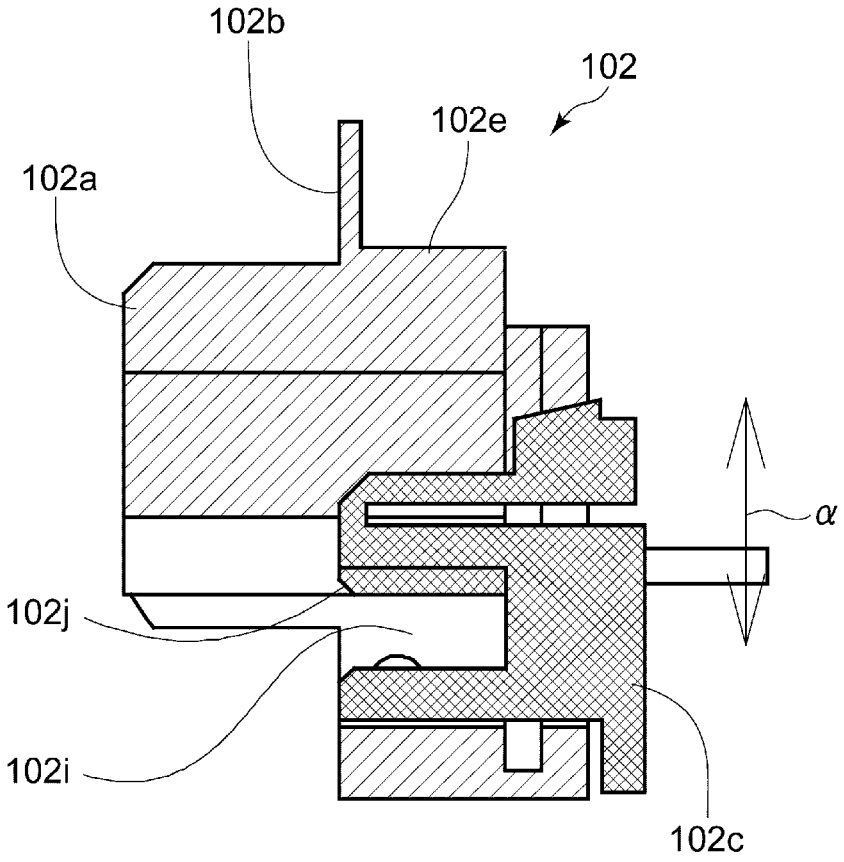
FIG. 6 is a sectional view taken along line VI-VI in part (a) of FIG. 6, and the hatched portion is a main assembly portion, and a cross-hatched portion is an electric energy supply portion.

As shown in FIG. 5, the supporting member 102 as a flange member includes an electric energy supply portion 102*c* (second supporting portion) which is contacted with an electroconductive portion of the heater to supply the electric power to the heat generating resistor layer of the heater 105 and which is a bundle of electric wires (unshown) for electric connection with a voltage source member (unshown) provided in the image forming apparatus. The portion of the flange member (supporting member 102) other than the electric energy supply portion 102*c* is a first supporting portion which is a main assembly portion 102*e* of the flange member. Referring to FIG. 5 through FIG. 10, the supporting member 102 as the flange member will be described in detail.

The belt member supporting portion 102*a* functions as a guide portion for guiding rotation of the belt member around the main assembly portion 102*e* and is part-cylindrical, wherein an end portion of the belt member 100 is fitted around the belt member supporting portion 102*a* to support the end portion of the belt member 100. Simultaneously, the belt member supporting portion 102*a* functions to guide the rotation of the belt member 100. The belt member supporting portion 102*a* may be integral with the main assembly portion 102*e* or may be separable from the main assembly portion 102*e* so that when the main assembly portion 102*e* is dismounted, the belt member supporting portion 102*a* remains at the end portion of the belt member 100. In this embodiment, the supporting portion 102*a* is integral with the main assembly portion 102*e*.

Designated by 102*b* is a fixing device frame holding portion which is slidably supported by the fixing device side plate 108 which is a frame of the fixing device. Furthermore, the fixing device frame holding portion 102*b* also functions as a stopper portion for limiting movement of the belt member 100 exceeding a predetermined distance in the longitudinal direction (axial direction).

The electric energy supply portion 102*c* which is the second supporting portion supports the heater 105 and the back-up member 103 and supplies the electric power to the heater 5. Since the electric energy supply portion 102*c* supports the back-up member 103, the back-up member 103 and the heater 105 are movably together with each other relative to the main assembly portion 102*e* at least in the direction indicated by an arrow α in FIG. 6. On the other hand, the main assembly portion 102*e* supports the stay 104 and the belt member 100.

Figure 7:
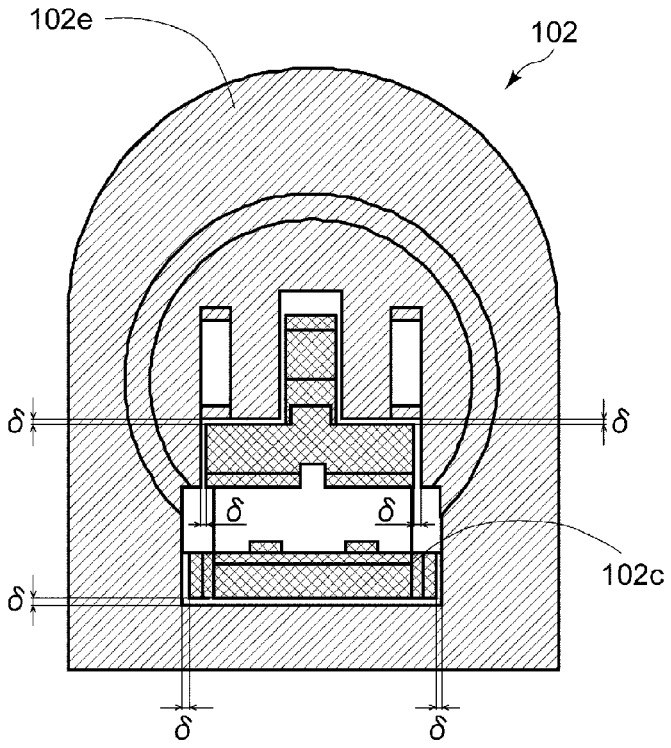
FIG. 7 illustrates a gap of a connecting portion between a main assembly portion (hatched portion) and the electric energy supply portion (cross-hatched portion).
Figure 8:
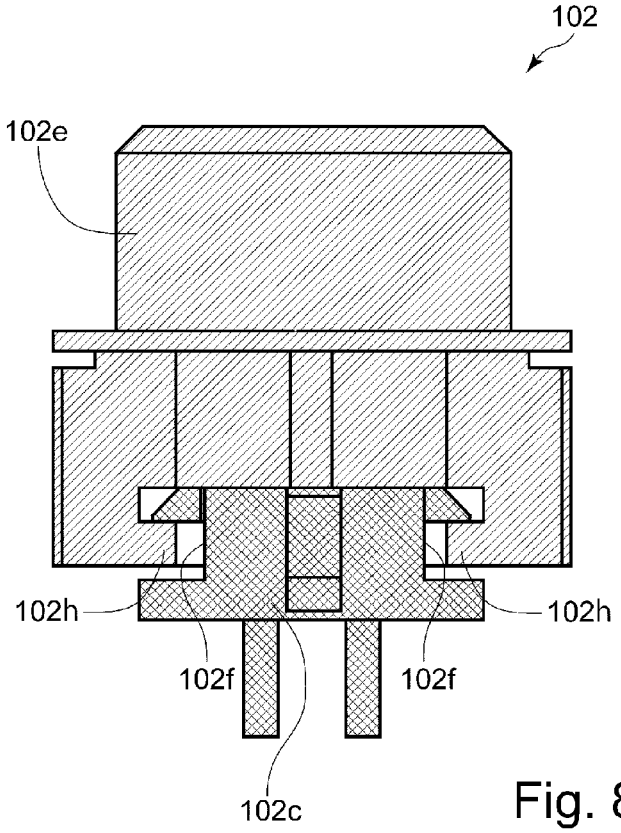
FIG. 8 illustrates a structure of the connecting portion between the main assembly portion (hatched portion) and the electric energy supply portion (cross-hatched portion).

As shown in FIGS. 2, 7 and 8, a connecting portion between the main assembly portion 102*e* and the electric energy supply portion 102*c* is constructed such that the electric energy supply portion 102*c* is disposed in a holding portion formed on the main assembly portion 102*e*. In this embodiment, the main assembly portion 102*e* and the electric energy supply portion 102*c* are integrally mounted and dismounted to the end portions of the stay 104 and the heater 105, and are relatively movable at least in a pressing direction of a compression spring 107 is a pressure applying member.

As shown in FIG. 7, in this embodiment, there are provided gaps (plays) δ of the approx. 0.5 mm in the vertical and left-right directions in the Figure. The electric energy supply portion 102*c* is movable relative to the main assembly portion 102*e* through distances corresponding to the gap δ in the vertical and left-right directions in FIG. 7. The vertical direction in FIG. 7 is the direction α in FIG. 6 and is the pressing direction of the compression spring 107. The left-right direction in FIG. 7 corresponds to a direction perpendicular to the sheet of this drawing of FIG. 6. The gap in the left-right direction may be zero or less than the other gap.

The supporting member 102 can be pulled out of the end portion of the belt member 100 in the direction of the rotational axis, integrally with the electric energy supply portion 102*c* and the main assembly portion 102*e*. In this embodiment, as shown in FIG. 8, grooves 102*f* is provided at the opposite end portions (in the left-right direction) of the electric energy supply portion 102*c*. On the other hand, ribs 102*h* are provided at the portions opposing the opposite end portions of the electric energy supply portion 102*c* where the electric energy supply portion 102*c* of the main assembly portion 102*e* is connected. By inserting the ribs of the main assembly portion 102*e* into the grooves 102*f* of the electric energy supply portion 102*c*, the electric energy supply portion 102*c* is movable as a unit in the rotational axis direction of the belt member 100 relative to the main assembly portion 102*e* (vertical direction in FIG. 8). Between the groove 102*f* and the rib, a gap may be provided to provide the movability in the rotational axis direction.

The stay holding portion 102*d* of the main assembly portion 102*e* is a groove extending in the rotational axis direction (longitudinal direction) of the belt member 100, and by inserting an end portion of the stay 104 into the groove in the longitudinal direction, the end portion of the stay 104 is supported by the main assembly portion 102*e*. On the other hand, the heater holding portion 102*i* formed on the electric energy supply portion 102*c* is a groove extending in the rotational axis direction of the belt member 100, and the end portions of the back-up member 103 and the heater 105 are inserted into the groove in the longitudinal direction. By this, the end portions of the back-up member 103 and the heater 105 are supported by the electric energy supply portion 102*c*. The holding portion 102*i* includes an electrical contact for supplying the electric power to the heater 105.

Figure 9:
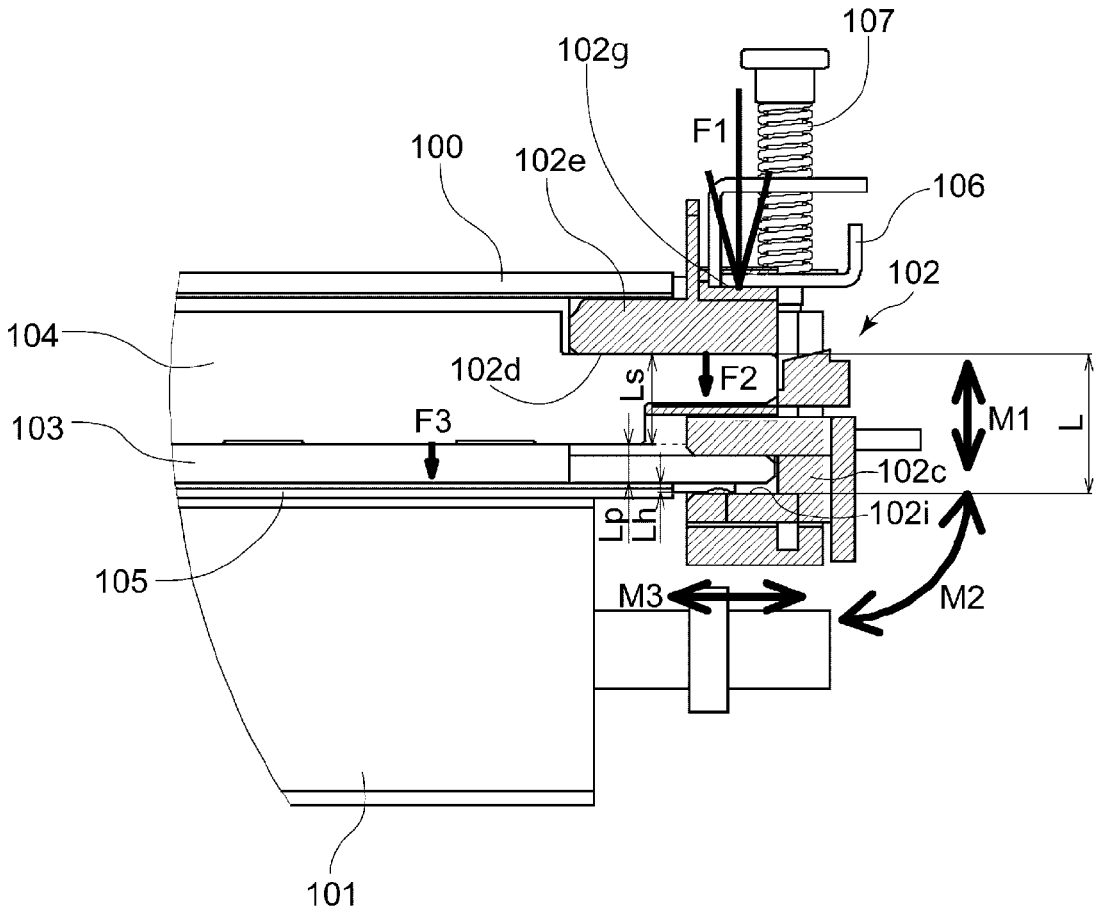
FIG. 9 is a sectional view of an end portion fixing device partly omitted, and illustrates a force applied to various parts by a pressure of a pressure applying member.

As described hereinbefore, in this embodiment, the main assembly portion 102*e* and the electric energy supply portion 102*c* are movable at least in the pressing direction of the compression spring 107 through a distance corresponding to the gap δ. A direct application of a large load to the heater 105 is prevented. Referring to FIG. 9, this will be described. FIG. 9 shows a positional relation among the forces and parts when the electric energy supply portion 102*c* is pressed by the compression spring 107 through the pressing member 106. The hatched portions in FIG. 9 is supporting member 102, the pressing direction of the compression spring 107 is vertical in FIG. 9.

A portion-to-be-pressed 102 *g* of the supporting member 102 is pushed by the compression spring 107 in the direction indicated by F1 in the Figure, by which the stay 104 supported by the main assembly portion 102*e* of the supporting member 102 at the opposite end portions is pushing down in the direction of the F2. At this time, the stay 104 press-contacts the back-up member 103 to the pressing roller 101 so that a nip N is formed between the belt member 100 and the pressing roller 101.

In this manner, the supporting member 102 is pressed by the portion-to-be-pressed 102*g*, while holding the back-up member 103, the stay 104 and the heater 105. Here, a distance L between a top surface (FIG. 9) of the stay holding portion 102*d* and the bottom surface (FIG. 9) of the heater holding portion 102*i* varies in the range of ±0.1 mm (tolerance), for example, from the standpoint of mass-production and manufacturing cost. A height Ls of the end portion of the stay 104, a height Lp of the end portion of the back-up member 103 and a height Lh of the end portion of the heater 105 also vary in the range of the tolerance of ±0.1 mm.

Therefore, a deviation in the positional relation between the actual position of the heater 105 and the heater holding portion 102*i* is unavoidable. In other words, in view of the unavoidable tolerance L is not necessarily equal to Ls+Lp+Lh.

For this reason, if the relative movement is not permitted between the main assembly portion 102*e* and the electric energy supply portion 102*c* of the supporting member 102, the deviation in the positional relation cannot be absorbed. If, in addition, the heater 105 is a ceramic heater, for example, the heater may be damaged by the load at the end portion depending on the degree of the deviation, since the ceramic is hard and brittle.

In this embodiment, the supporting member 102 is provided with a gap between the electric energy supply portion 102*c* and the main assembly portion 102*e*, as shown in FIG. 7. By this, the electric energy supply portion 102*c* is movable corresponding to the above-described gaps relative to the main assembly portion 102*e* in perpendicular direction M1, a rotational moving direction M2, a longitudinal direction M3, and a direction perpendicular to the sheet of the drawing of FIG. 9.

Therefore, when back-up member 103 is pushed by the stay 104 to form the nip N between itself and the pressing roller 101, which nips the belt member 100, the electric energy supply portion 102*c* moves in accordance with the movement of the back-up member 103 and the heater 105. Thus, the movable structure can absorb the difference due to the tolerance (difference between L and Ls+Lp+Lh) by the movement corresponding to the gap so that an excessive load application to the heater 105 can be avoided. In this embodiment, the relative movement is possible in the direction M2 as well as M1, but it may be permitted only in the direction M1 since what is required is to absorb the dimensional tolerance in the pressing direction of the compression spring 107 at least.

In addition, in this embodiment, the main assembly portion 102*e* and the electric energy supply portion 102*c* are integrally mountable and demountable, and therefore, the exchange of the belt member 100 is easy. The exchange of the belt member 100 in this embodiment will be described. First, only the belt member unit is taken out of the fixing device 40. The belt member unit is the part of the structure shown in FIG. 2 except for the pressing roller 101 and includes the members in the belt member 100.

The supporting member 102 includes the belt member supporting portion 102*a* and is pulled out in the longitudinal direction the belt member unit (rotational axis direction of the belt member 100). As will be understood from FIG. 8 which is a top plan view as seen in the pressing direction, the electric energy supply portion 102*c* is engaged with the main assembly portion 102*e* by the grooves 102*f* and the ribs 102*h*. Therefore, by the abutment between the side surface of the groove 102*f* and the side surface of the rib 102*h*, the main assembly portion 102*e* and the electric energy supply portion 102*c* can be pulled out as a unitary part.

Figure 10:
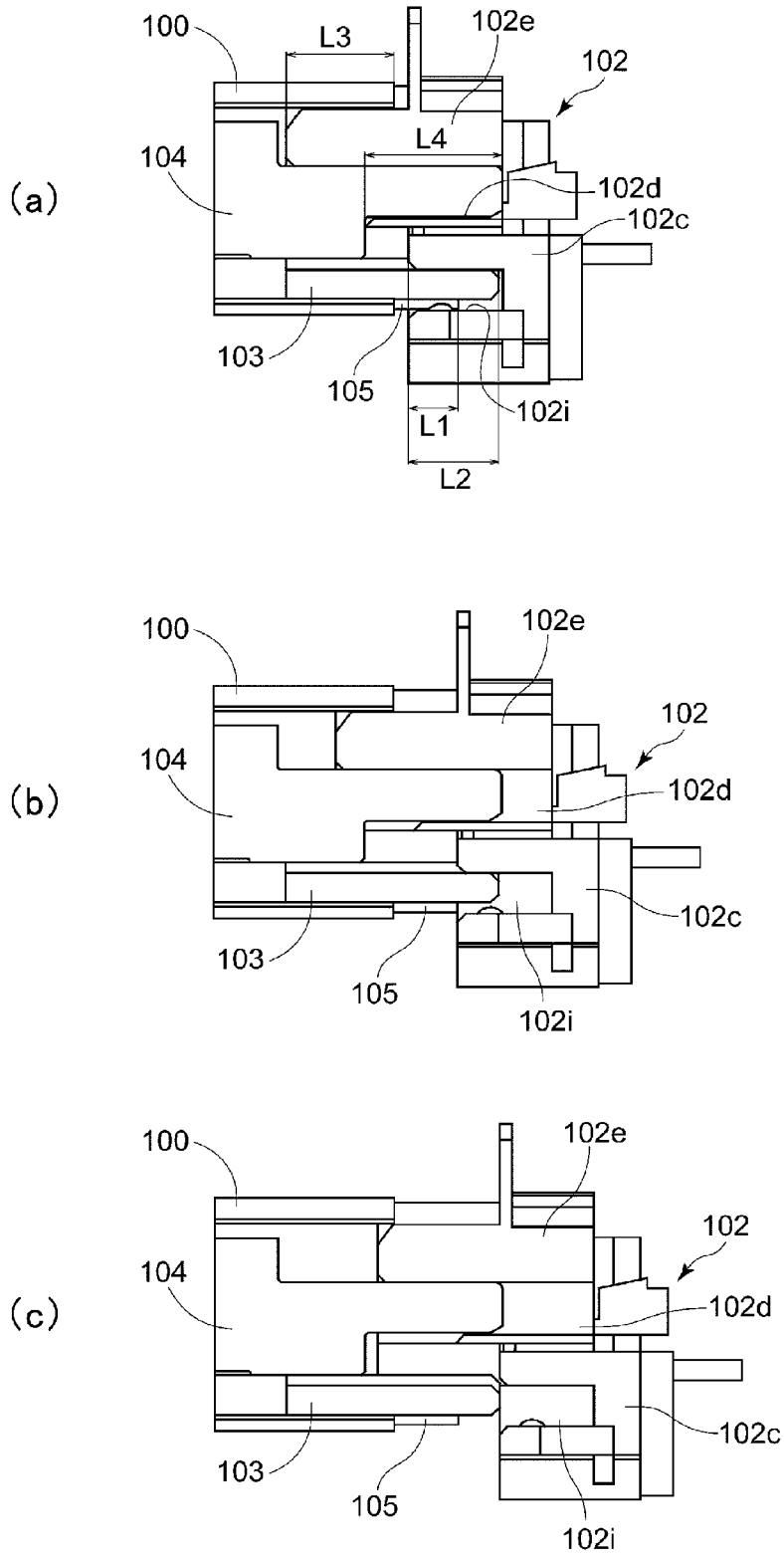
FIG. 10 is a sectional view of an end portion fixing device partly omitted, and illustrates gradual pulling of the supporting member from an end portion of a belt member.

Referring to FIG. 10, the description will be made as to the movement when the supporting member 102 is pulled in the longitudinal direction of the belt member unit and the load applied to the heater 105 at this time.

Part (a) of FIG. 10 is a sectional view illustrating a state in which the supporting member 102 supports the belt member 100, the back-up member 103, the stay 104 and the heater 105. Designated by L1, L2, L3, L4 are lengths of the belt member 100 supported by the supporting member 102, measured in the axial direction. More particularly, L1 is a length over which the end portion of the heater 105 is supported by electric energy supply portion 120*c*; L2 is a length over which the end portion of the back-up member 103 is supported by the electric energy supply portion 102*c*; L3 is a length over which the end portion of the belt member 100 is supported by the main assembly portion 102*e*; L4 is a length over which the end portion of the stay 104 is supported by the main assembly portion 102*e*. They satisfy relations L1<L2<L3<L4. because of these relations satisfied, when the supporting member 102 is being pulled, the supporting member 102 moves as shown in part (a) to the part (b) of FIG. 10, and the heater 105 which is most shortly supported by the supporting member 102 first disengages from the supporting member 102. Then, the back-up member 103 disengages as shown in part (c) of FIG. 10. Further, the belt member 100 and then the stay 104 disengage from the supporting member 102 so that the supporting member 102 is pulled out of the belt member unit. Thereafter, the belt member 100 is pulled out of the belt member unit which is free of the supporting member 102. Thus, the exchange of the belt member 100 is enabled easily by pulling the supporting member 102 out of the belt member unit.

The dimensional relations L1<L2<L3<L4 will be described further.

Because of these relations, the heater 105 is first pulled out, and then the back-up member 103, the belt member 100 and the stay 104 are pulled out in this order, and therefore, application of a large load to the heater 105 at the time of exchange of the belt member 100 can be avoided. Even if the supporting member 102 is pulled obliquely, the load is received mainly by the stay 104 and/or the back-up member 103 as long as the supporting member 102 holds the heater 105. The reason is as follows. Since the heater 105 is first pulled, the position of the supporting member 102 is limited by the back-up member 103 and the stay 104. As a result, the large load application to the heater 105 can be avoided even if the supporting member 102 is pulled obliquely. In addition, after the heater 105 is pulled out of the supporting member 102, the heater 105 is not confined inside the belt member 100, and therefore, the large load application can be avoided. Thus, the application of an excessive load to the heating source upon pulling can be avoided.

When a new belt member 100 is mounted, the supporting member 102 is pushed from the end portion by which the supporting member 102 supports the stay 104, the belt member 100, the back-up member 103 and the heater 105 in this order. At the inserting opening where the stay 104, the belt member 100, the back-up member 103 and the heater 105 enter, tapered portion is provided so that these members are smoothly guided and mounted. For example, the tapered portion which receives the back-up member 103 is indicated by 102*j* in FIG. 6. Upon the insertion of the belt member 100, an excessive load application to the heater 105 can be avoided similarly to the case of the pulling.

In the foregoing embodiment, the back-up member 103 is supported by the electric energy supply portion 102*c* together with the heater 105, but the back-up member 103 may be supported by the main assembly portion 102*e*. In the foregoing embodiment, the stay 104 is pressed toward the pressing roller 101 by the compression spring 107, but the pressing roller 101 may be pressed toward the stay 104, instead. The gaps between the main assembly portion 102*e* and the electric energy supply portion 102*c*, that is, the relatively movable amount is properly determined by ordinary skilled in the art in consideration of the dimensional tolerances and the pressing load or the like.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 264056/2011 filed Dec. 1, 2011, which is hereby incorporated by reference.

What is claimed is:

1. An image heating apparatus comprising:

an endless belt;

a plate-like member, including a heat generating element, which is slidable on an inner surface of said endless belt;

a driving rotatable member, opposed to said plate-like member through said endless belt, configured to (i) rotate said endless belt and (ii) form a nip for heating an image on a recording material;

an electrical connector sandwiching said plate-like member from front and rear sides of said plate-like member and configured to supply electrical energy to said heat generating element;

a flange member including a guide portion configured to guide rotation of the endless belt and a limiting portion configured to limit movement of said endless belt in a longitudinal direction of said endless belt; and a pressure applying member configured to apply a pressure between said flange member and said driving rotatable member, wherein said flange member includes a holding portion configured to hold said electrical connector so that said flange member is disengageable in the longitudinal direction relative to said endless belt integrally with said electrical connector and wherein said holding portion holds said electrical connector so as to permit a relative movement between said electrical connector and said flange portion in a pressing direction of said pressure applying member.

2. An apparatus according to claim 1, wherein said pressure applying member presses said flange member toward said driving rotatable member.

3. An apparatus according to claim 1, further comprising a back-up member made of resin material and configured to back up said plate-like member over a length of said plate-like member, and a stay configured to reinforce said back-up member over the length, wherein said flange member holds a longitudinal end portion of said stay.

4. An apparatus according to claim 3, wherein said electrical connector nips a longitudinal end portion of the back-up member.

5. An apparatus according to claim 4, wherein a length L1, measured in an axial direction of said endless belt, over which said plate-like member is supported by said electrical connector, a length L2 over which said back-up member is supported by said electrical connector, a length L3 over which said endless belt is supported by said flange member, and a length L4 over which said stay is supported by said flange member, satisfy, $$L1<L2<L3<L4.$$

* * * * *